US010207135B2

(12) United States Patent
Payton et al.

(10) Patent No.: US 10,207,135 B2
(45) Date of Patent: Feb. 19, 2019

(54) PORTABLE WATER STORAGE SYSTEM

(71) Applicants: Jason Payton, East Bridgewater, MA (US); Mike Payton, East Bridgewater, MA (US); Tim Duquette, East Bridgewater, MA (US)

(72) Inventors: Jason Payton, East Bridgewater, MA (US); Mike Payton, East Bridgewater, MA (US); Tim Duquette, East Bridgewater, MA (US)

( * ) Notice: Subject to any disclaimer, the term of this patent is extended or adjusted under 35 U.S.C. 154(b) by 0 days.

(21) Appl. No.: 15/440,015

(22) Filed: Feb. 23, 2017

(65) Prior Publication Data

US 2018/0236285 A1 Aug. 23, 2018

(51) Int. Cl.
*A62C 35/60* (2006.01)
*A62C 37/50* (2006.01)
*A62C 35/68* (2006.01)

(52) U.S. Cl.
CPC ..... *A62C 37/50* (2013.01); *A62C 35/68* (2013.01); *A62C 35/60* (2013.01)

(58) Field of Classification Search
CPC ..... A62C 27/00; A62C 37/50; A62C 99/009; B67D 7/84; B67D 7/845; B67D 7/58; B67D 7/70; B08B 9/032
USPC ..... 169/16, 24, 62
See application file for complete search history.

(56) References Cited

U.S. PATENT DOCUMENTS 2,421,765 A 6/1947 Taylor
3,920,552 A * 11/1975 Elkern ..... B01F 5/0612 210/141
3,976,087 A 8/1976 Bolton et al.
4,793,386 A * 12/1988 Sloan ..... E03F 7/10 137/351
5,095,578 A 3/1992 Wade
5,601,659 A 2/1997 Rohrbacher
5,826,663 A * 10/1998 Sundholm ..... A62C 3/00 169/24
6,302,967 B1 10/2001 Rohrbacher et al.
8,813,779 B2 8/2014 Criss et al.
9,011,681 B2 4/2015 Hawks
9,322,306 B2 * 4/2016 Erwin ..... F04B 49/065
2003/0080196 A1 * 5/2003 Clum ..... A62C 35/68 239/1
2009/0064544 A1 3/2009 Rajewski
2011/0174706 A1 7/2011 Russell
2012/0031440 A1 2/2012 Crompton

FOREIGN PATENT DOCUMENTS

CN 103485387 1/2014
WO 2004099093 11/2004
WO 2009021272 2/2009

* cited by examiner

*Primary Examiner* — Timothy L Maust
*Assistant Examiner* — Timothy P. Kelly
(74) *Attorney, Agent, or Firm* — Lambert Shortell & Connaughton; Gary E. Lambert; David J. Connaughton, Jr.

(57) ABSTRACT

A portable water storage system for draining and refilling building fire protection systems is provided. The system includes a tank for storing fire protection system water, a hose connecting the building fire protection system to the tank. A vacuum pump is configured to draw a low pressure on the fire protection system. A water pump is configured to return the water of the fire protection system from the tank to the system.

10 Claims, 2 Drawing Sheets

PORTABLE WATER STORAGE SYSTEM

BACKGROUND OF THE INVENTION

Field of the Invention

The present invention relates generally to portable water storage systems. More particularly, the present invention relates to a mobile system that can drain building fire safety systems, store the drained water, and then refill the drained system with the same water drained, saving on usage.

Description of Related Art

Building fire protection systems, such as automatic building sprinkler systems, may need to be drained for a number of reasons. For example, restoring an activated dry or wet-pipe system after use, sprinkler repair, expanding an existing system, inspection, maintenance, and the like. Generally, draining of the system involves waste of the drain water.

Therefore, what is needed is a water storage system that can recycle the drained water from the fire protection systems.

SUMMARY OF THE INVENTION

The subject matter of this application may involve, in some cases, interrelated products, alternative solutions to a particular problem, and/or a plurality of different uses of a single system or article.

In one aspect, a portable water storage system for draining and re-filling building fire protection systems is provided. The system has a water tank for storing water from and/or for the fire protection system. At a first end, the hose is connected to the water tank. At a second end, the hose is connectable to the building fire protection system. A vacuum pump is connected to the hose and configured to draw a negative pressure on the hose during a draining of the building fire protection system. Once work, inspection, or the like, that required the draining of the fire protection system has completed, the vacuum pump may be deactivated, and the system prepared to re-fill the fire protection system and/or when the system is drained. A water pump is connected along the flow line of the hose and is configured to pump water from the tank into the building fire protection system.

In another aspect, a water storage system connected to a building fire protection system is provided. As above, the system has a water tank for storing water from and/or for the fire protection system. At a first end, the hose is connected to the water tank. At a second end, the hose is connected to the building fire protection system. A vacuum pump is connected to the hose and configured to draw a negative pressure on the hose. A water pump is connected along the flow line of the hose and arranged to pump water from the tank into the building fire protection system. The building fire protection system has a quantity of piping with at least one sprinkler head at an outlet(s) of the piping. The building fire protection system also includes a drain port, which is configured for a draining and/or filling of the system. The hose second end is connected to this drain port.

DETAILED DESCRIPTION

Figure 1:
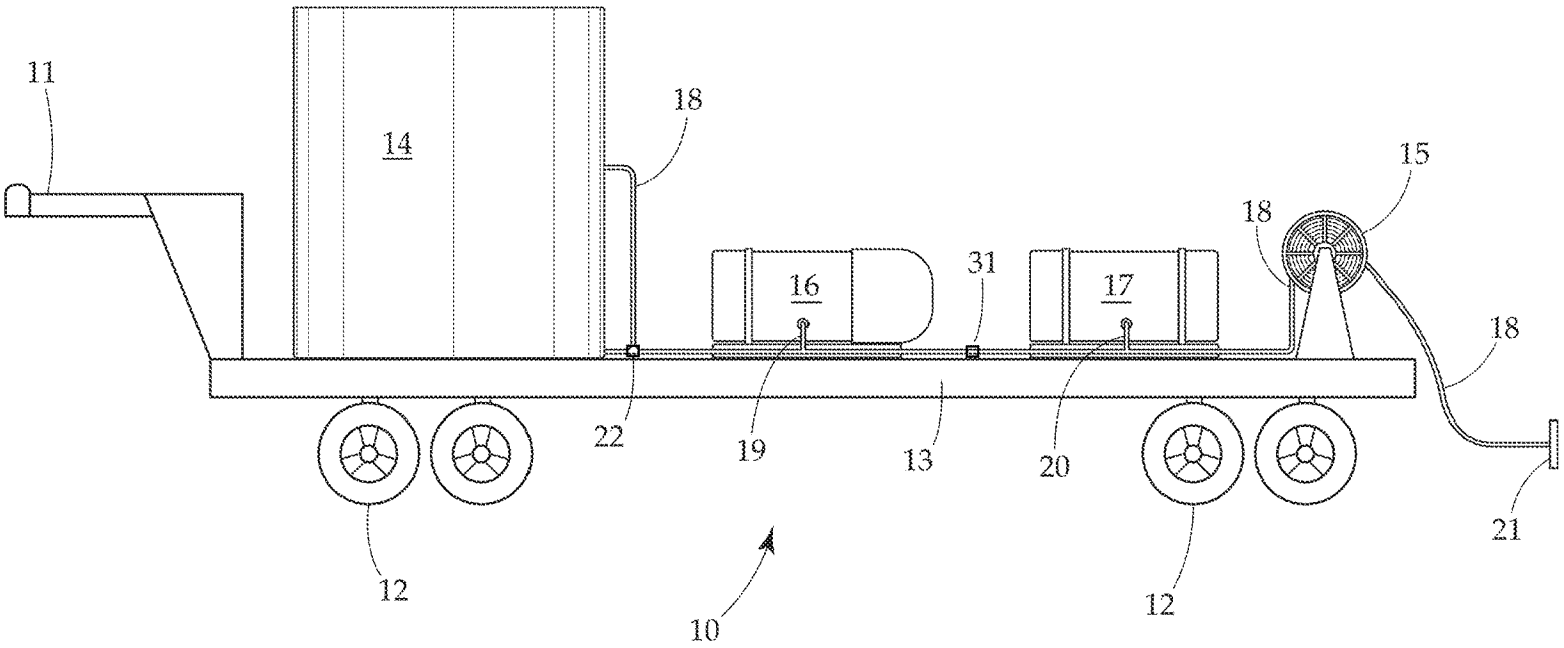
FIG. 1 provides a side view of an embodiment of the present invention showing the various components.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a portable system for draining water from building fire safety systems-such as wet pipe sprinkler systems, and then returning this drained water after maintenance, inspection, or the like is finished.

The portable water storage system generally includes a tank for receiving drained water, a hose system for connecting the fire safety system to the tank, a vacuum pump to draw negative pressure on the fire safety system during and/or after draining, and a water pump to return the water from the tank back to the fire safety system. In varying embodiments, the present invention may be used with water, or other fluid systems such as antifreeze. While the term "water" is used herein to discuss system operation, it should be understood that "water" may also refer to any other fire suppressing fluid, such as antifreeze, water mixtures and solutions, and the like.

One common type of fire safety system is a "wet pipe" building sprinkler system. These systems include piping throughout a building with sprinkler heads positioned in various places to spray water in the event of a fire. Wet pipe systems contain water within the pipes so that as soon as a sprinkler is activated, water is available for spraying. In many cases, water tanks are part of this system to provide a contained water source, so the sprinkler does not have to rely on water flow from a well or municipal water source. These tanks may or may not be drained as part of the operation of the present invention.

During maintenance or inspection of wet pipe systems, it is typically necessary to drain the systems so that the system components can be accessed without excess water spillage. These systems generally have a drain port or ports that allows draining of the water into a building drain or outside. Dry pipe systems, which do not have fluid-filled pipes when not in operation, also have similar aspects and similar drain/access ports that allow the present invention to be used for maintenance.

The present invention is configured to be connected to the aforementioned drain ports to capture the water drained from the fire safety system. A hose is configured to be attachable to the drain port of a fire safety system, allowing water to pass through the hose into the system tank. Upon substantial draining of the building fire protection system, the vacuum pump of the system may be activated to draw a negative pressure on the building fire protection system. This aids in drawing trapped water out of the building fire protection system, and limiting spillage during maintenance, service work, and/or inspection. In particular, once a component of the system (such as a sprinkler head, plug, piece of pipe, etc.) is removed so that the system is opened the vacuum pump draws water to the tank. A water pump may then pump the water back into the building fire protection system once work is completed. In one embodiment, a filter may be positioned on along a flow path from the tank back to the system. The filter may clean the water before it is returned to the fire protection system. In embodiments configured for use on dry pipe fire protection systems, an air compressor may be part of the system. The air compressor may be used to fill the dry pipe system to a working pressure, and to aid in removing fluid that may be in the system after a fluid pressure test.

In most embodiments, the present invention is configured to be portable. In one embodiment, it is mounted on a trailer that may be attached to a vehicle and brought from site to site. The portable system may be fully contained in many embodiments, including a generator to supply power to the pumps. A single tank may be used, or multiple tanks may be employed. In one embodiment, the tank may be a single 1200 gallon tank. In another embodiment, four 330 gallon tanks may be used. In a particular embodiment, a second tank may be used in the system. The second tank may be filled with fresh water (or other fire suppression fluid). In such an embodiment, instead of refilling the system with the drained fluid, the fresh fluid may be pumped in using the water pump connected to the second tank.

Turning now to FIG. 1, one embodiment of the portable water storage system is provided. The portable water storage system is mounted on a trailer 10, which has a number of wheels 12 and a tongue 11 for connection to a vehicle. On the trailer 10 are components of the system. A tank 14 is sized and configured to receive water drained from a fire safety system without overflow. This draining may include both draining of piping of the fire safety system as well as water supply tanks, depending on system configuration. A hose 18 is connected to the tank 14 for flow into and out of the tank 14. In some embodiments, the hose 18 may connect through a drain manifold connected to one or more tanks. Hose 18 extends to a hose reel 15 which can provide wrapped storage of the hose when not in use. The hose 18 distal end extends or is extendable away from the trailer 10. At the distal end of the hose 18 is a connector 21 such as a cam lock fitting, or the like, which allows connection of the hose to a drainage port of a fire safety system.

A vacuum pump 17 is in communication with the hose 18 through connection 20, which may be a manifold, direct connection, or the like. The vacuum pump 17 is configured to draw a low pressure (a pressure less than atmospheric pressure) on the hose 18. In a particular embodiment, an isolation valve 31 may be configured to isolate the vacuum pump 17. For example, the valve 31 may be on the hose 18 upstream of the vacuum pump (that is—between the vacuum pump 17 and the tank 14) to limit the low pressure to be drawn downstream of the pump—drawing a pressure on the fire protection system and not on the tank. The vacuum pump 17 is configured to urge stuck water out of the system, enhancing draining and limiting spillage. Specifically, the vacuum pump 17 aids in getting as much old water in the system as possible, especially when removing system components in a variety of locations in the building fire protection system.

A water pump 16 is also in communication with the hose 18 by connection 19, which may be a direct connection, a manifold, or the like. In one embodiment, the water pump 16 may be a 175 gallon-per-minute pump. In many embodiments, the water pump 16 may be arranged to pump water from the tank 14 back into the fire protection system after draining. An isolation valve may also be positioned on the hose 18 or connection 19 to isolate the water pump 16 when not in use. The water pump 16 further may be configured to re-pressurize the fire protection system. In another embodiment, a second separate pump (not shown) may be utilized for re-pressurizing. This re-pressurizing may be performed using fluid from the tank 14 or a separate water source. Power sources for the vacuum and/or water pumps 17, 16 may be part of the trailer 10 or may be external.

In a particular embodiment, a valve 22 may control the hose connection to the tank. The valve 22 may allow that during the draining process, the water flow is at a middle or top of the tank flowing in, while during the re-filling of the fire protection system process, the water may be drawn from a bottom of the tank. A simple three way valve or its equivalent may be used in such embodiments to control flow path. Typically, the same hose 18 provides the flow path for both draining of the system and re-filling of the system.

Figure 2:
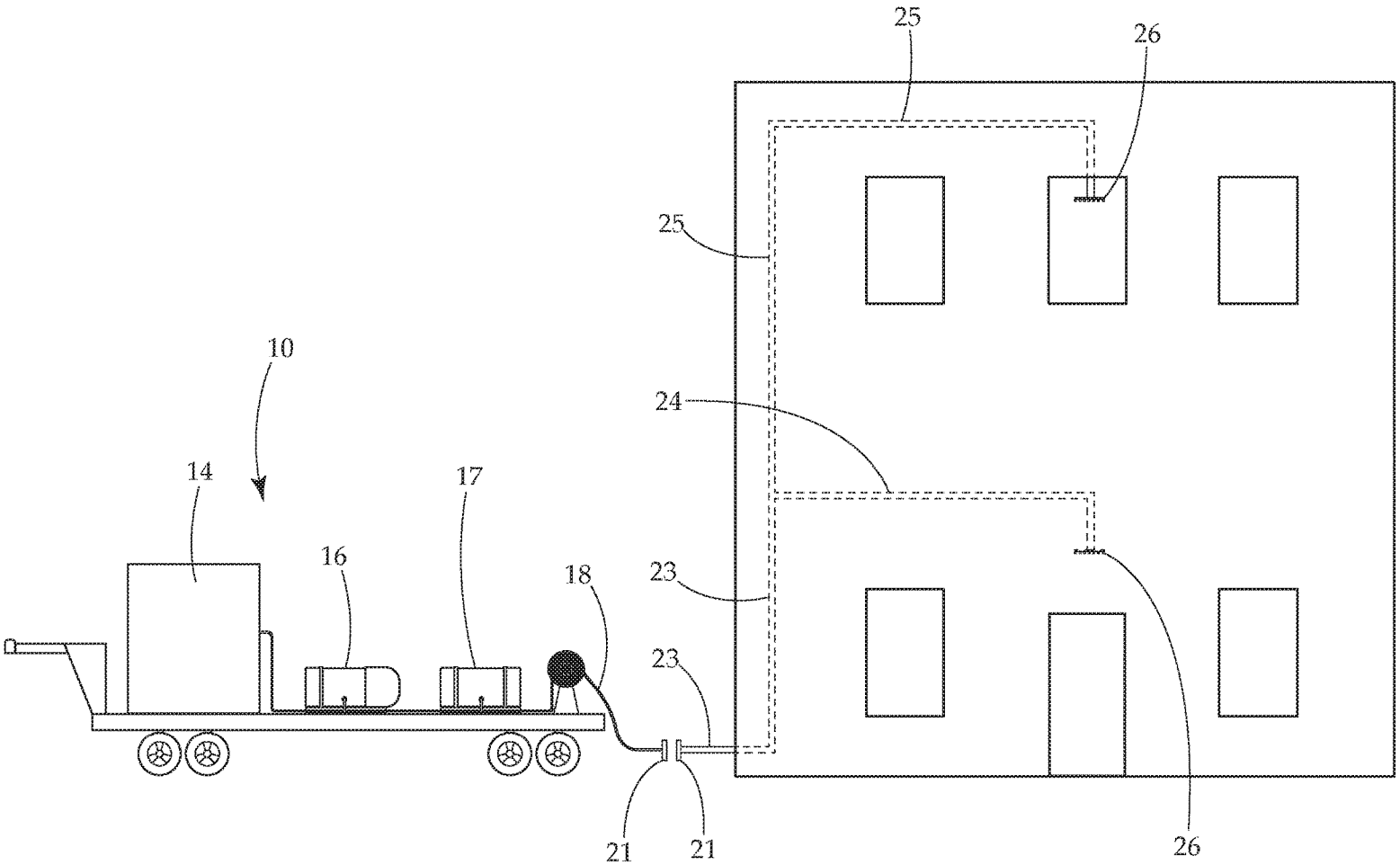
FIG. 2 provides a view of an embodiment of the present invention connected to a building fire protection system.

FIG. 2 shows another embodiment of the present invention being used and connected to a building fire protection sprinkler system. In this view, the trailer 10 contains the tank 14, water pump 16, and vacuum pump 17. These components operate as discussed with regard to FIG. 1. The hose 18 extends to the building system and is connected to a drain port. The connector 21 of the hose 18 is connected with the drain port 21 of the building system. A pipe 23 extends into the building, splitting into first floor piping 24 and second floor piping 25. Spray heads 26 are positioned at outlets of the pipings 24, 25.

In one embodiment of use, the present invention system may be moved to a position near a building fire protection system. Likely this movement may be vehicle aided, such as by driving a truck connected to a trailer on which the invention is mounted. A hose, such as a two inch hose, can be drawn from the system and connected to a drain of the building fire protection system, for example a wet pipe sprinkler system. After connecting the hose, the water may be drained through the hose into the tank. Once substantially drained, the vacuum pump may be activated to draw the low pressure on the hose and fire protection system. This helps capture as much water as possible, and enhances working conditions by drawing out trapped water within the system. For example, if a pipe connection or valve is opened, it may allow for free flow of previously stationary water. The negative pressure will urge the free flowing water out of the system. The vacuum pump may provide a steady suction on the system while drained. In one embodiment, the vacuum pump is configured to be left on until re-filling is desired.

After the work is completed, and/or the fire protection system is to be re-filled, the vacuum pump may be deactivated. For filling and/or re-filling, appropriate valves may be opened or closed, depending on embodiment, and then the water pump may be activated. This water pump conveys the water drained from the fire protection system, which is stored in the tank, back through the hose and into the building fire protection system. Once all of the water, or as much as possible, has been returned to the system, a valve on the fire protection system may be closed, and the water storage system may be detached. In the event that the fire protection system has not been fully re-pressurized, additional water may be pumped in using either the water storage system of the present invention, or an external water source.

In another embodiment of use, the present invention may be used on new construction/installation of a fire protection system. In such embodiments, typically municipal water sources have not been connected to the building yet and thus there is no on site water. The water storage system of the present invention may be moved adjacent to the building. The hose may be drawn out and connected to the fire protection system. In this embodiment, the water storage system may have its tank already filled with water. Here, the water pump may be activated, and the system filled with the water from the tank until the system reaches the desired pressure. In some embodiments, the water storage system may include a built in secondary hydrostatic test pump to allow testing of the fire protection system and/or to raise the sprinkler system to a working pressure if the building has a fire pump, or if the building is higher in elevation such that the primary water pump is not powerful enough to bring the system to the desired pressure. In a specific embodiment, the hydrostatic test pump can be used to raise the pressure within the building fire protection system to a testing pressure. This allows testing of the system to ensure it is in good working condition. After the pressure testing is complete, the system may be slightly drained to return it to holding pressure. Such operation applies to both wet and dry fire protection systems, with the difference being that in dry systems, more fluid is drained after the pressure test.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A fluid handling system comprising:

a portable fluid storage system comprising:

a fluid tank;

a hose connected to the fluid tank at a first end, and having a second end connected to a building fire protection system;

a fluid pump configured to pump a quantity of fluid from the fluid tank to the building fire protection system; and a vacuum pump configured to draw a negative pressure on the hose second end; and wherein the building fire protection system comprising:

a quantity of piping;

at least one sprinkler head; and a drain port, wherein the hose second end is connected to the drain port.

2. The portable fluid storage system of claim 1 wherein the fluid tank, hose, fluid pump, and vacuum pump are all connected to a vehicle trailer.

3. The portable fluid storage system of claim 1 wherein the fire protection system is a wet pipe sprinkler system.

4. The portable fluid storage system of claim 1 further comprising a valve positioned near the first end of the hose, the valve capable of providing an inlet flow to the tank in a first position of the tank in a first valve position, and an outlet flow from the tank from a bottom of the tank in a second valve position.

5. The portable fluid storage system of claim 1 further comprising a plurality of tanks.

6. The portable fluid storage system of claim 1 further comprising a hose reel, the hose wrappable about the hose reel.

7. The portable fluid storage system of claim 1 further comprising an isolation valve along the hose between the vacuum pump and the tank.

8. The portable fluid storage system of claim 1 further comprising a secondary fluid pump configured to pump fluid into the fire protection system through the hose.

9. The portable fluid storage system of claim 1 further comprising a generator configured to power the fluid pump and the vacuum pump.

10. The portable fluid storage system of claim 1 wherein the vacuum pump is configured to be continuously operated after a draining of the building fire protection system into the tank.

* * * * *